US005470259A

United States Patent [19]

Kaufman et al.

[11] Patent Number: 5,470,259

[45] Date of Patent: Nov. 28, 1995

[54] GROUNDING SHROUD FOR SURFACE MOUNTED ELECTRICAL CONNECTOR

[75] Inventors: John W. Kaufman, Hershey; John A. Root, Middletown; James L. Schroeder, III, Palmyra, all of Pa.

[73] Assignee: The Whitaker Corporation, Wilmington, Del.

[21] Appl. No.: 350,202

[22] Filed: Dec. 5, 1994

[51] Int. Cl.[6] ..... H01R 13/648

[52] U.S. Cl. ..... 439/607; 439/101; 439/540.1

[58] Field of Search ..... 439/92, 95, 101, 439/108, 607, 609, 629–635, 79, 540, 636–637

[56] References Cited

U.S. PATENT DOCUMENTS

| | | | |
|---|---|---|---|
| 3,775,643 | 11/1973 | Schachnow et al. | 317/101 DH |
| 3,932,016 | 1/1976 | Ammenheuser . | |
| 4,046,443 | 9/1977 | Champagne . | |

OTHER PUBLICATIONS

The Whitaker Corporation Case No. 15811; Abstract and Drawings Only.
The Whitaker Corporation Case No. 15812; Abstract and Drawings Only.
PC Card Standard Release 2.0; PCMCIA; Sep. 1991; 17 pages.
Memory/PC Card Connector; Revised Dec. 1991; 4 pages.
Interconnection Technology; Aug. 1992; "Surface Mount Connector Hold Downs"; 6 pages.
"Surface Mount Connector Hold Downs"; Report by H. Collins and T. Kocher; AMP Publication; 11 pages.

*Primary Examiner*—Khiem Nguyen
*Attorney, Agent, or Firm*—Katherine A. Nelson

[57] ABSTRACT

A conductive ground shroud (50) for use with an electrical connector (22) having a plurality of electrical terminals (36) with surface mountable contact sections (42) for electrically engaging circuitry (84) on a circuit board (80). The shroud (50) provides ground reference for the terminals (36). Shroud 50 includes an electrically conductive plate-like body 52 having first and second portions, (54, 62) the first portion (54) adapted to be disposed on a board remote surface (26) of the connector housing. The second portion is configured to extend over the surface mountable contact sections (42) when the shroud (50) is disposed on housing (24). The second portion (62) includes at least one second contact section (70) extending outwardly therefrom for engagement to ground circuitry of circuit board (80). The second portion further includes at least one elongated aperture (64) extending therethrough proximate the surface mountable contact sections (40). Upon disposing the shroud (50) on connector (22), mounting the connector (22) and shroud (50) to circuit board (80) and soldering the surface mountable contact sections (42) to corresponding circuit pads (84) on board, aperture (64) permits sufficient heat generated during the soldering process to reach contact pads (84) to melt the solder thereby assuring electrical engagement of contact sections (42) with corresponding pads (84).

4 Claims, 6 Drawing Sheets

GROUNDING SHROUD FOR SURFACE MOUNTED ELECTRICAL CONNECTOR

FIELD OF THE INVENTION

The present invention relates to conductive shrouds used to provide a ground reference with respect to signal carrying pins in electrical connectors associated with the shroud and more particularly to a conductive shroud for use with a connector having surface mounted leads.

BACKGROUND OF THE INVENTION

As part of its effort to standardize the interface of the electronic equipment, the electronic industry has established pin assignments for some of the connectors that will be used in the interface. For various computer applications, it is desirable to interconnect memory cards. The Personal Computer Memory Card International Association (PCMCIA) has established standards for interconnecting memory cards. A sixty-eight pin connector, for example, is often used. This connector has sixty signal pins, four ground return pins and four DC voltage pins, all of which are preassigned by the industry in the standards. The connectors may be through hole mounted or surface mounted. The signal to ground ratio of an electrical connector is equal to the number of signal carrying pins divided by the number of ground return pins in the connector. For the purposes of the present disclosure the DC voltage pins can be considered similar in effect to the AC voltage ground pins, thus the signal to ground ratio of the sixty-eight pin connector is 7.5 to 1.0. Typically in computer applications multiple lines are simultaneously switched and all return current generated;by this switching must be returned through one of the ground pins. The return current of eight or so signal pins, therefore, must be accommodated by a single ground pin. When the signal rise time is relatively slow, in the eight to ten nanosecond range, this presents no problem. When the rise time decreases i.e. to 1–3 nanoseconds, however, as in certain computer applications the induced voltage is increased resulting in "ground bounce" or common mode noise in the ground return pins. When the ground bounce reaches a high enough level, relative to the level of the signals, the systems may become unable to reliably read and respond to the signals thereby causing what is known in the industry as "false triggering". Since the pin assignments have been fixed by the industry, the signal to ground ratio cannot be altered. To reduce the adverse effects o the faster rise times a conductive shroud may be used to electrically interconnect the ground of the memory card to the ground of the equipment with which the card is being used.

One such shroud and a related connector are disclosed in U.S. Pat. No. 5,288,247, issued Feb. 22, 1994, to Kaufman. The shroud of the '247 patent is arranged to enclose the top of the connector and two sides thereof. A shroud for multiple connectors in a vertically Stacked relationship is disclosed in U.S. Pat. No. 5,399,105, and also owned by the present assignee. A connector and shroud assembly for use with grounded and ungrounded memory cards is disclosed in U.S. patent application Ser. No. 08/283,312, also owned by the present assignee. The connectors in the three references are top board mounted having terminal leads that are received in through holes of the circuit boards. Each of the shrouds in the above references is mounted on a board remote surface of the connector and is electrically connected to ground circuitry on a circuit board. The performance of the equipment is greatly improved by the use of such shrouds.

To achieve a more uniformed distribution and flow of current, it is generally desirable that a ground shroud include a plurality of interconnections with the circuit board ground. One way of achieving this capability with top board mounted connectors is to provide a shroud of the type that has a plate-like section extending above the formed pins at the back of the connector and a back wall having a plurality of contact sections at desired locations therealong for engaging ground circuitry on the board.

While a shroud of the type described above is suitable for top board mounted connectors having terminal members that have leads that are received in through holes on the circuit board, a problem arises when using this type of shroud with connectors having surface mounted leads. The top and back walls of the shroud prevent heat from reaching the solder paste or other material used for interconnecting the leads and circuit pads during the soldering process. Furthermore, the shroud walls prevent visual inspection of the soldered connections.

Although a two step mounting process, that is, first soldering the connector with the surface mountable leads to the board and then securing the conductive shroud to the already mounted connector and soldering the shroud to respective ground circuitry is possible; the additional manufacturing steps are not cost effective.

It is desirable, therefore, to provide a ground shroud for connectors having surface mountable leads that permits simultaneous mounting of the connector and shroud to the board and also allows visual inspection of the terminal leads after the soldering process is complete.

SUMMARY OF THE INVENTION

The present invention is directed to a shroud for a top board mounted electrical connector having surface mount terminal leads that overcomes the deficiencies described above. The conductive ground shroud is arranged for electrically engaging ground circuitry on the circuit board at a plurality of locations to provide a ground reference with respect to the pins while simultaneously providing access for heat associated with the soldering process to reach the surface mount contacts thereby permitting simultaneous soldering of the connector and shroud and visual inspection of the surface mounted contacts.

The conductive ground shroud includes an electrically conductive plate like body having first and second portions, the first portion being adapted to be disposed on a board remote surface of the electrical connector housing and a second portion configured to extend over the surface mountable contact sections when the shroud is disposed on the housing, the second portion having at least one elongated aperture extended therethrough proximate the surface mountable contact sections. The first shroud portion includes at least one first contact section adapted to engage a ground contact of a mating electrical device and the second portion has at least one second contact section extending outwardly therefrom for engagement to the ground circuitry of the circuit board. Upon disposing the shroud on the connector housing and mounting the housing and shroud to the circuit board and soldering the surface mountable contact sections and the shroud contact section to the respective board circuitry the at least one aperture permits sufficient heat generated by a board remote source during the soldering process to reach the contact pads thereby melting the solder to assure electrical engagement of the terminals with the circuitry.

In the preferred embodiment, the second shroud portion includes a plurality of apertures or slots extending in the same direction as the terminal leads. The slots preferably extend across the top plate surface and partially down the back wall of the shroud.

The present invention has the advantage of allowing the shroud and connector to be soldered to a circuit board simultaneously. A further advantage of the present invention is that the aperture allows for visual inspection of the surface mount terminals and circuit pads after the soldering process has been completed.

An embodiment of the invention will now be described by way of example with reference to the accompanying drawings.

DETAILED DESCRIPTION OF THE PREFERRED EMBODIMENT

Electrical connector assembly 20 of the present invention includes electrical connector 22 and a shroud 50. For purposes of illustrating the invention connector 22 is shown as a top board surface mounted connector for a card reader. It is to be understood that the improved shroud of the present invention may also be used with receptacle connectors to be mated with shielded or unshielded plug connectors. When using a connector assembly with memory cards as identified by PCMCIA standards, the memory cards need to be oriented in a specific direction. The embodiment shown herein is for memory cards having the ground contacts on their upper surfaces. In some applications the assembly may also include an eject mechanism for the card proximate the circuit board. The connectors shown herein can be used in combination with numerous ejector mechanisms as known in the art.

Figure 1:
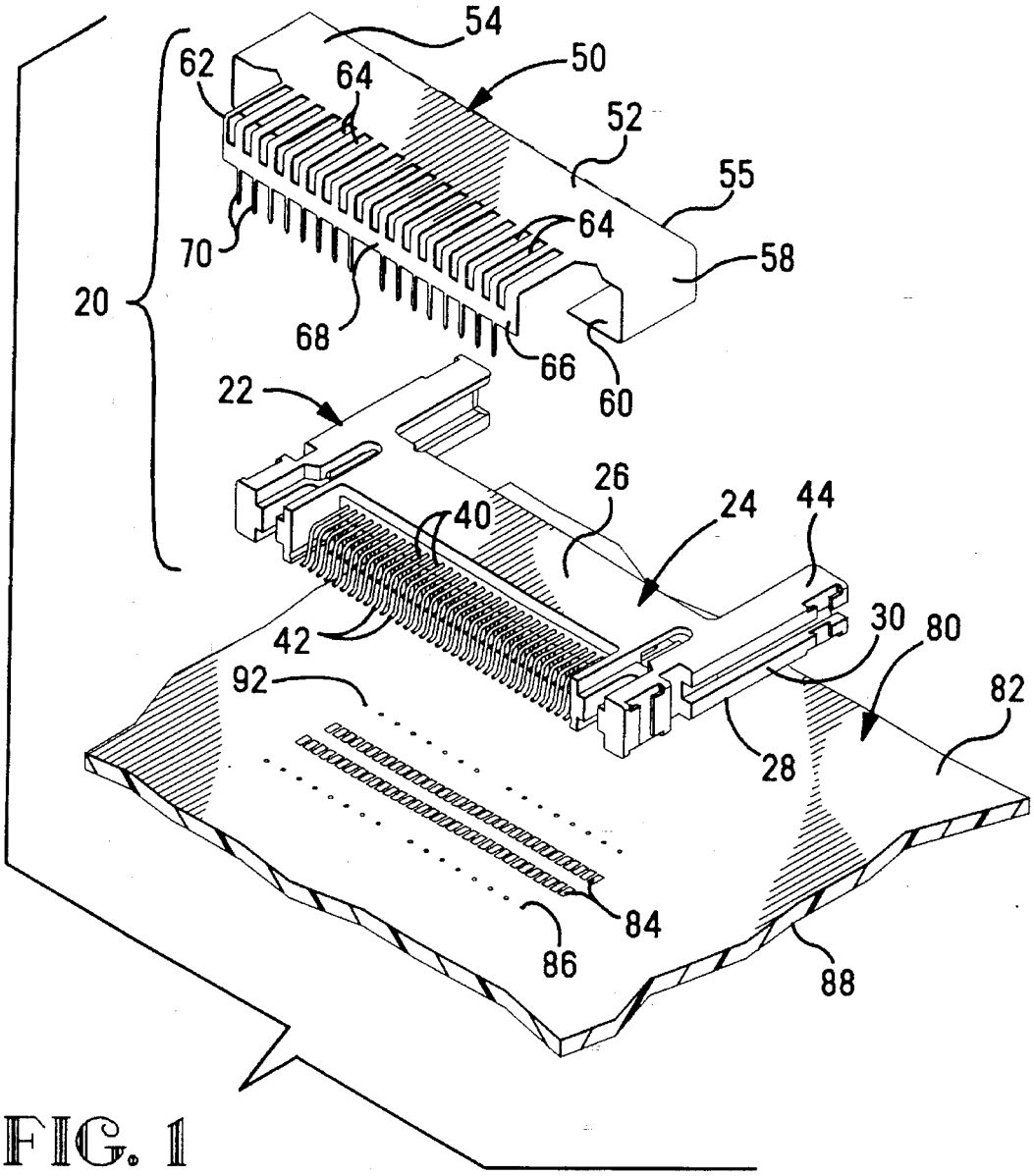
FIG. 1 is a perspective view of a shroud made in accordance with the invention exploded from a connector having surface mounted terminals, the connector being exploded from a circuit board to which the connector and shroud are to be mounted.

Referring now to FIGS. 1 to 6, the connector 22 of the present invention includes a housing 24 having a first major or board remote side 26 and an opposed second major or board proximate side 28, and opposed minor sides 30 together defining a card receiving mouth 32. A portion of the card receiving mouth 32 defines a card receiving space 34. A plurality of electrical terminals 36 are disposed within the housing 24, the terminals 36 having first and second connecting portions 38,40 respectively. The first connecting portions 38 extend into the card receiving space 34 and are adapted for mating with complementary terminals of a memory card (not shown). The second connecting portions 40 include as contacts at leading ends 42 adapted for being surface mounted to respective circuit pads 84 of a circuit board 80, as best seen in FIG. 1. In the embodiment as illustrated, connector 22 further includes card guide arms 44 extending outwardly thereof for receiving a card. The housing is preferably made from high temperature dielectric materials that can withstand soldering temperatures in the range of 230° C., such as liquid crystal polymers and other materials known in the art.

Figure 2:
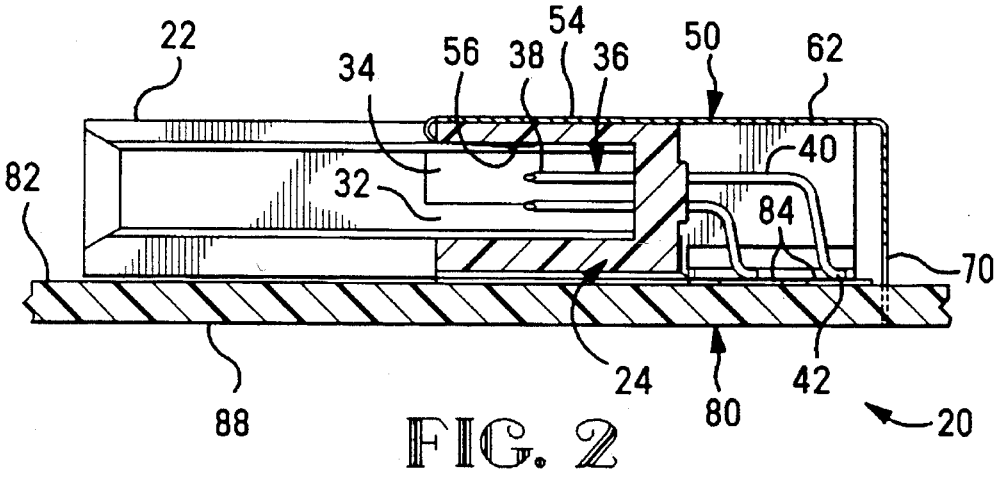
FIG. 2 is a cross-sectional view of the assembled shroud and connector.
Figure 3:
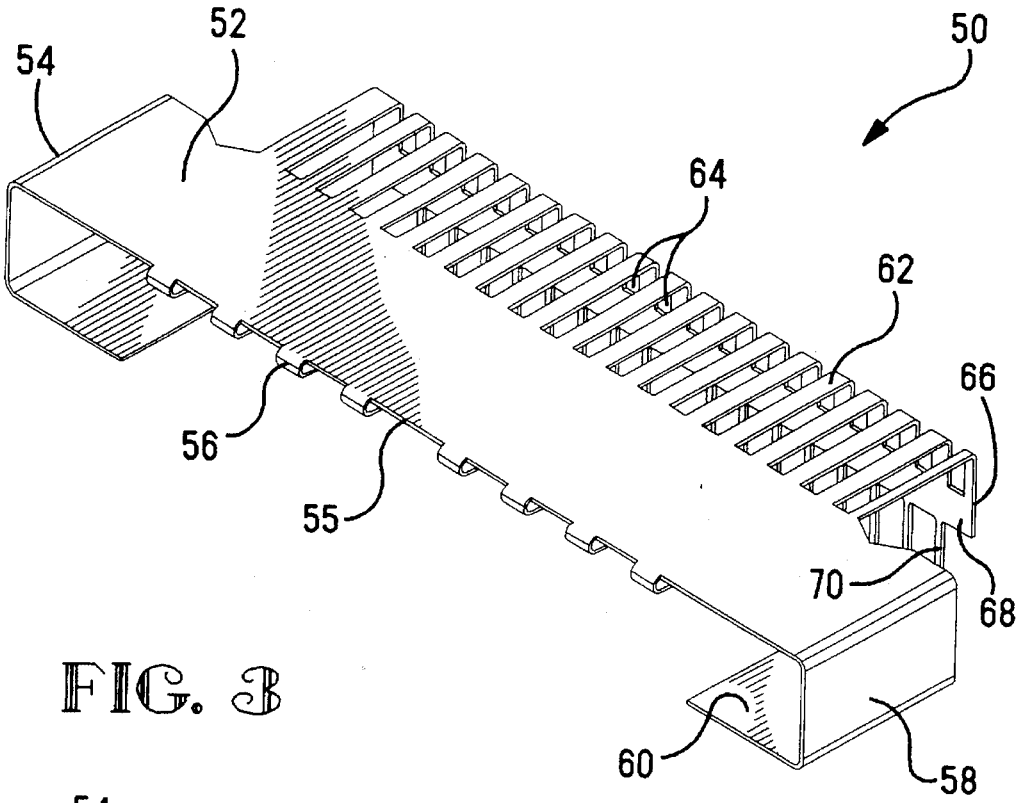
FIG. 3 is a perspective view of the front of the shroud of FIG. 1.
Figure 4:
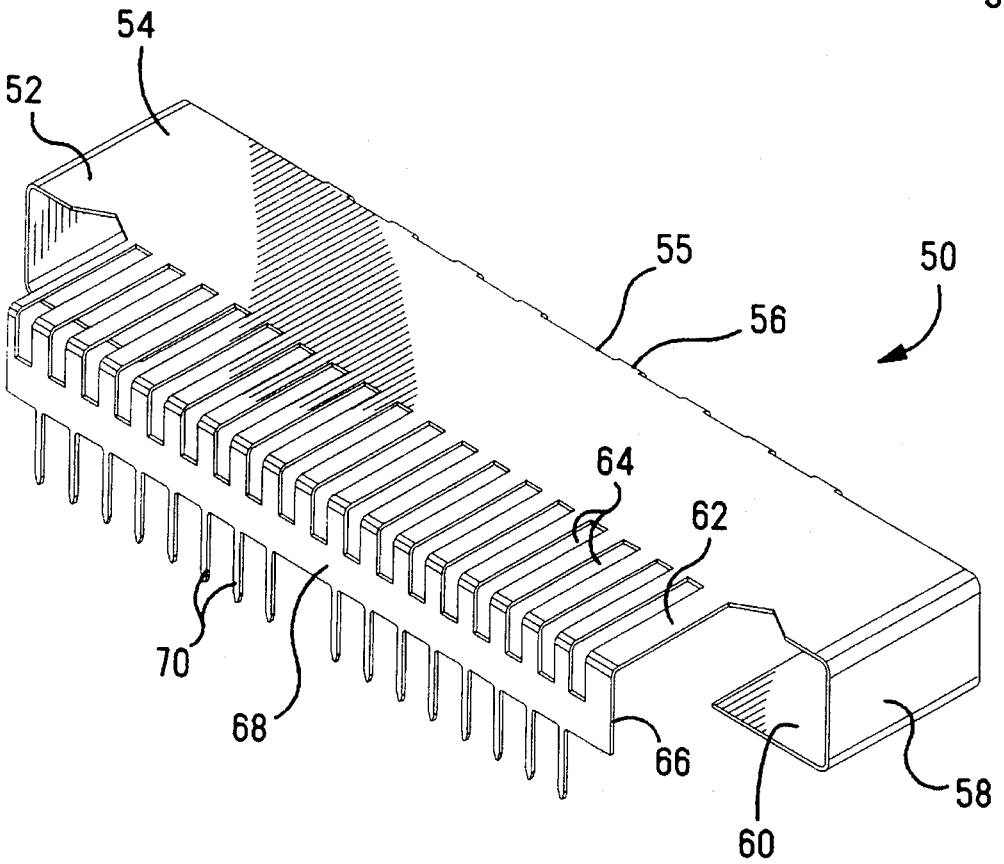
FIG. 4 is a perspective view taken from the back of the shroud of FIG. 1.
Figure 5:
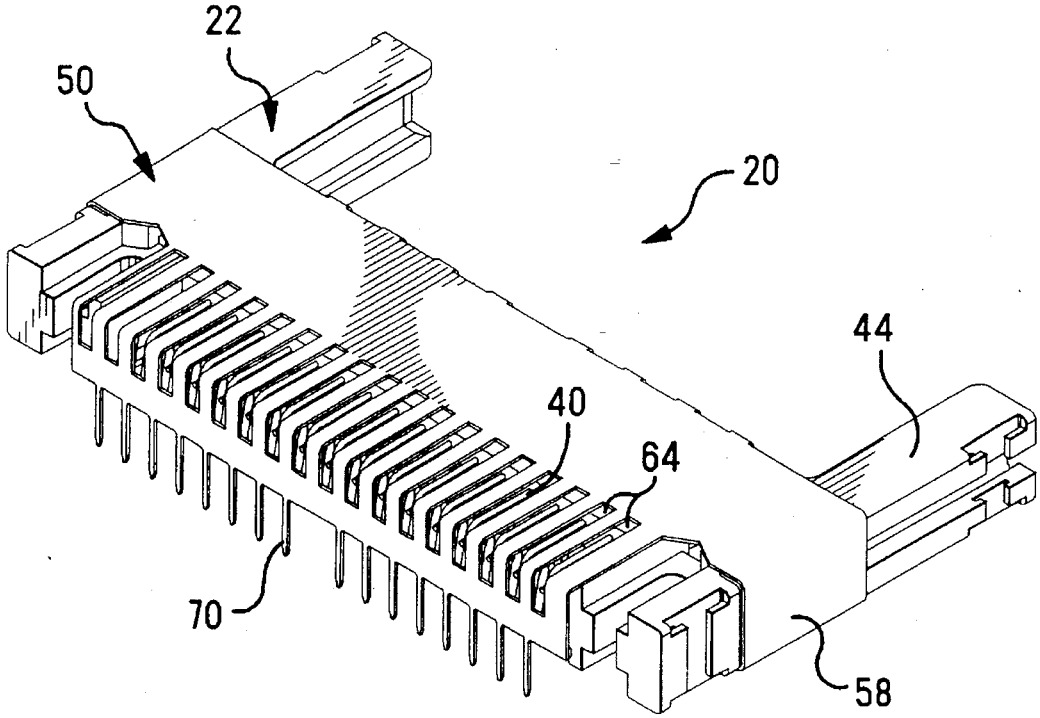
FIG. 5 is a view similar to FIG. 4 with the shroud mounted on the connector of FIG. 1.
Figure 6:
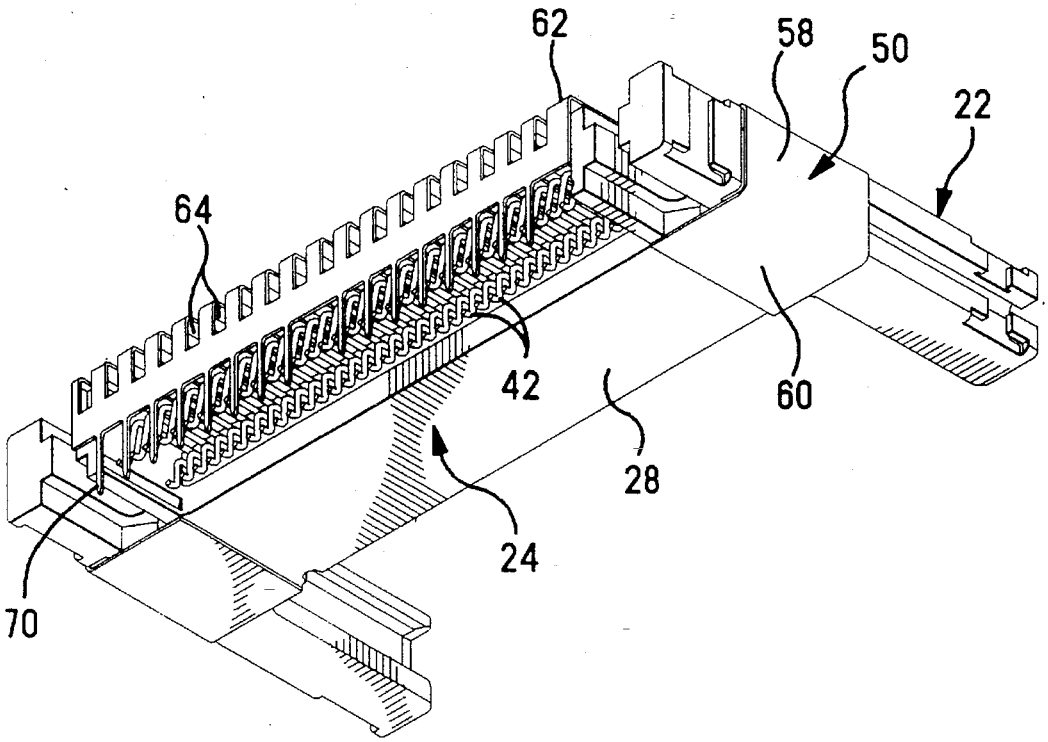
FIG. 6 is a view of the assembly of FIG. 5 taken from the board mounting surface of the connector.

The structure of shroud 50 can best be understood with reference to FIGS. 3 and 4. Conductive shroud 50 is a unitary member including a top plate surface 52 having first portion 54 and a second portion 62. First portion 54 includes a plurality of spring fingers 56 extending from the leading edge 55 thereof. Spring fingers 56 are adapted to be received in card receiving mouth 32 as seen in FIG. 2 and electrically engage ground contacts on the memory card inserted into the mouth 32. Fingers 56 are of the type disclosed in the previously discussed patent and patent applications. Shroud 50 includes side walls 58 extending from the first portion 54. Shroud 50 further includes lower flanges 60 extending from the side walls 58 adapted to extend beneath the connector housing 24 as seen in FIG. 6. The flanges 60 may serve as additional conductive pads that can be secured and referenced to ground electricalpotential by being electrically connected to corresponding pads on a circuit board as discussed in U.S. Pat. No. 5,288,247. Second portion 62 of shroud 50 further includes a back wall 66 having a plurality of terminal members 70 extending downwardly therefrom for electrical engagement with ground circuits in the circuit board. Terminal members 70 are held in true position by the strap-like section 68 of second shroud portion 62. For purposes of illustration, terminal members 70 are shown as leads that are received in through-holes,of a circuit board. It is to be understood that these leads may be surface mountable leads as well as the leads of the connector. The shroud is preferably made from a highly conductive material, such as phosphor-bronze or the like as known in the art.

The second shroud portion 62, as best seen in FIGS. 3 and 4 includes a plurality of apertures 64 or slots extending in the same direction as the terminal members 36. The slots 64 preferably extend rearwardly from the first plate portion 54 and partially down the back wall 66 of the shroud, ending at strap-like section 68. The slots 64 overly portions of the terminals 36 that extend outwardly of the housing 24 and are sufficient in number to permit visual inspection of the underlying connecting portions 40 and in particular contacts 42 when the shroud is disposed on the housing 24.

In assembling top board surface mounted connector 20, plate portion 52 of shroud 50 is placed over the board remote surface 26 of housing 24, the spring fingers 56 are slid into position within the card receiving mouth 32 and side edges 58 and flange 60 are wrapped around the housing 24. In mounting connector 20 to top board surface 82, the surface mounted leads are brought into engagement with corresponding circuit pads 84 and terminal member leads 70 are inserted into the corresponding through-holes 86 as shown in FIG. 2. As known in the art, the circuit pads 84 and through holes 86 are provided with solder paste or the like prior to mounting the connector and shroud assembly 20 to the board 80. The mounted assembly is then passed through an infrared oven at about 230° C. using standard soldering procedures. The elongated apertures or slots 64 enable heat to reach the solder paste on the circuit pads causing it to melt thereby effecting electrical interconnection. For purposes of this disclosure, the term solder paste is to be understood to include conductive adhesives and the like that may be used to effect mechanical and electrical interconnect between the leading ends 42 and pads 84. After the soldering process has been completed the slots 64 permit visual inspection of the soldered connections.

Figure 7:
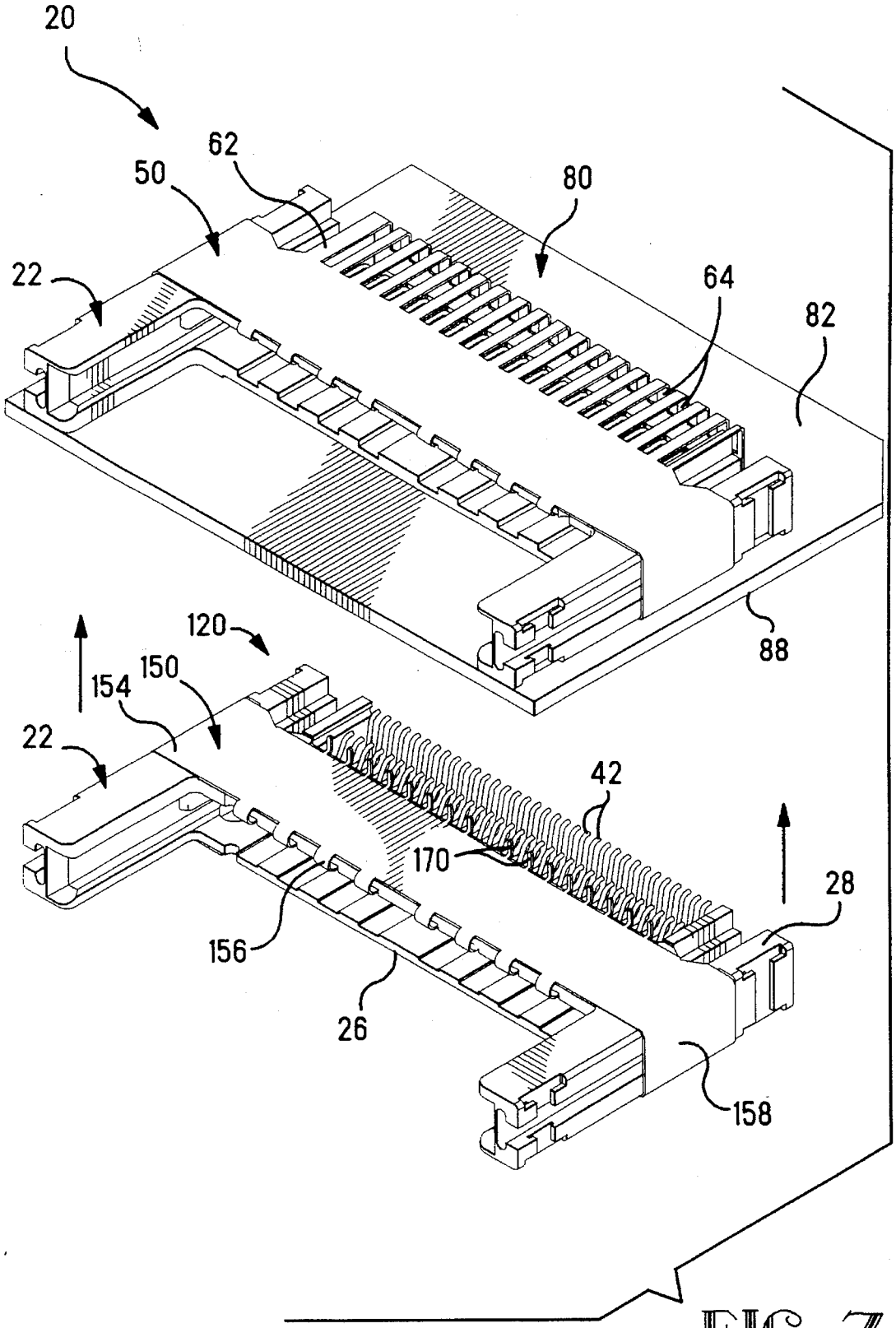
FIG. 7 shows the connector of FIG. 5 mounted to one side of a circuit board and having a second shrouded surface mount connector exploded from the bottom of the circuit board for a stacked configuration.

Memory card assemblies are often used in stacked relationship. One method of stacking the connectors is by mounting memory cards on opposed surfaces 82, 88 of a circuit board 80 as shown in FIGS. 7–10. FIG. 7 shows a connector assembly 20 as previously described mounted to a first or top major surface 82 of circuit board 80 and having a second connector assembly 120 exploded from the second or bottom major surface 88. The structure of the ground shrouded connector 120 differs from the ground shrouded structure of connector assembly 20 as previously described. In order to keep the memory cards on both sides of the stacked assembly oriented in the same direction, that is with the ground contacts on the upper surface thereof, the shroud 150 for assembly 120 is attached to the board proximate surface 28 of the connector housing 24, rather than the board remote surface 26 of the connector housing 24 as previously described. Thus the shroud 150 has terminal members 170 extending upwardly from the main body portion 154, and requires no further structure to extend over the terminals.

Figure 8:
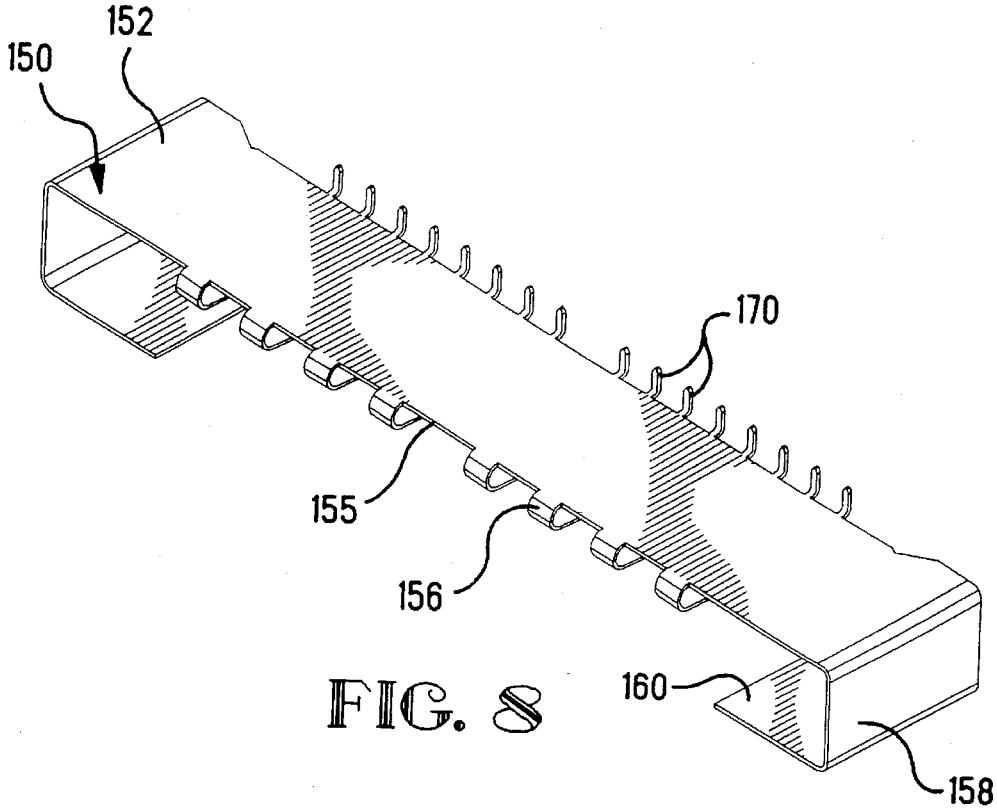
FIG. 8 is a perspective view of the shroud used with the second or bottom board surface mounted connector.

The details of the structure of shroud 150 are shown in FIG. 8. Shroud 150 includes a top plate surface 152 having side walls 158 and flanges 160. The leading edge 155 of plate section 152 includes spring fingers 156 which operate in the same manner as previously described. The terminal members 170 of shroud 150 are adapted to be received in the through-holes 92 of circuit board 80 as seen in FIGS. 1.

Figure 9:
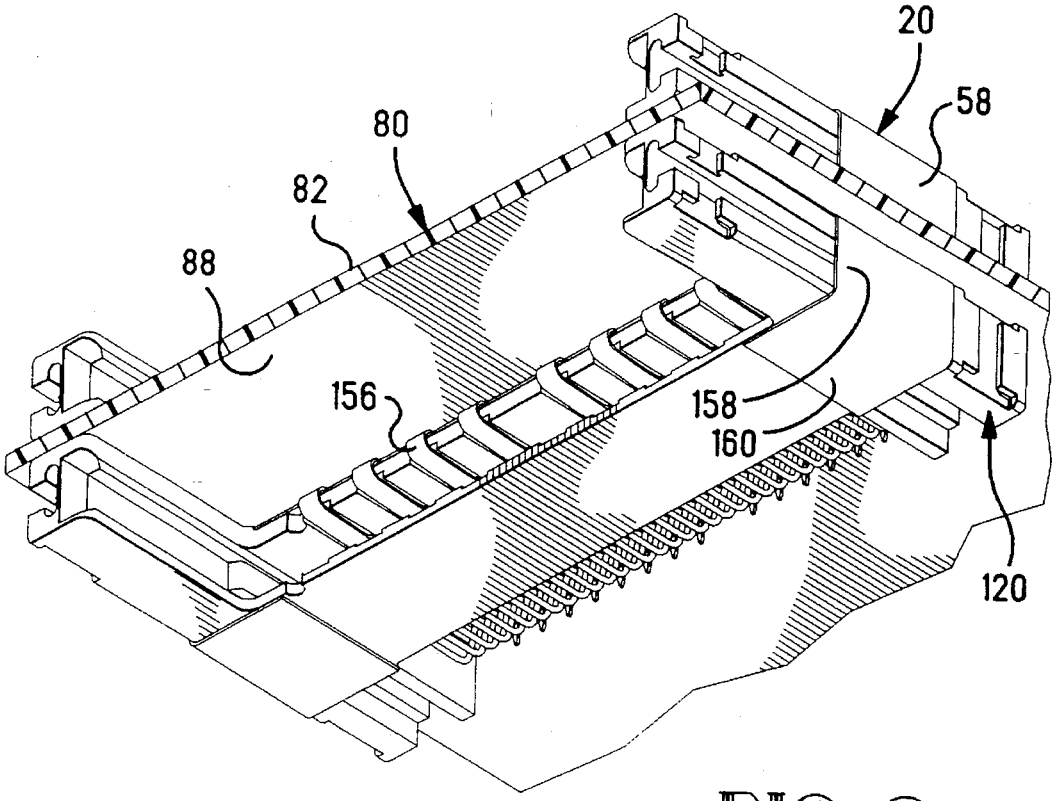
FIG. 9 shows a stacked assembly of connectors having surface mounted leads and ground shrouds.
Figure 10:
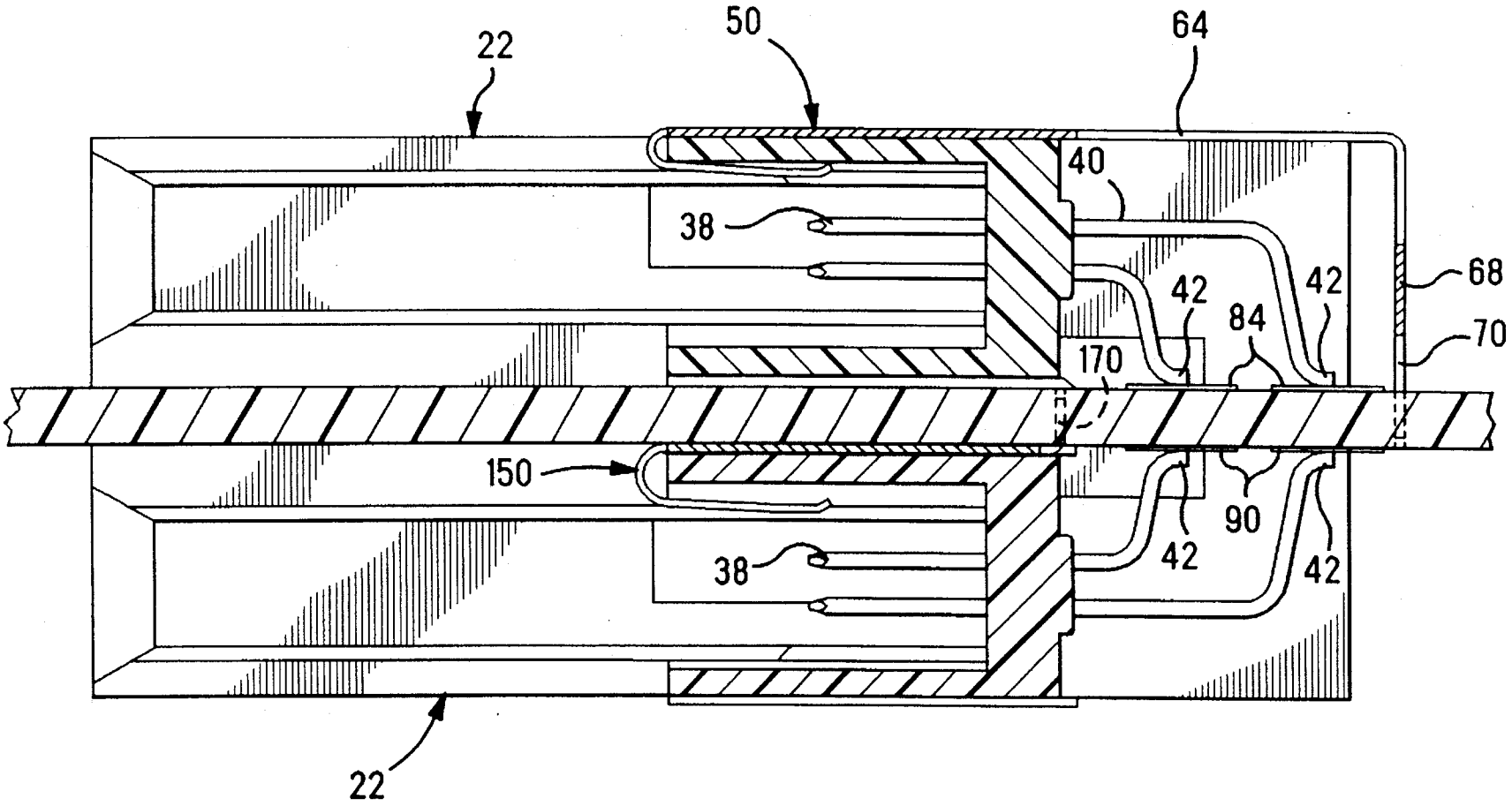
FIG. 10 is a cross-sectional view of the assembly of FIG. 9.

FIGS. 9 and 10 show the assembled stacked card assembly with a respective terminal leads 42 secured to the circuit pads 84, 90 on the opposed surfaces 82, 88 of circuit board 80 and respective ground terminal members 70, 170 in their respective through holes 86, 92.

It is thought that the ground shroud and connector assembly of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A conductive ground shroud for use with an electrical connector having a housing and a plurality of electrical terminals with surface mountable contact sections extending outwardly thereof for electrically engaging circuitry on a circuit board, said connector being adapted to receive and electrically mate to an electrical device, said shroud comprising:

an electrically conductive plate-like body having first and second portions, said first portion being adapted to be disposed on a board remote surface of said connector housing, said first portion including at least one first contact section adapted to engage a ground contact of the mating electrical device; and said second portion being configured to extend over said surface mountable contact sections when said shroud is disposed on said housing, said second portion having at least one second contact section extending outwardly therefrom for engagement to ground circuitry of said circuit board;

said second portion further including at least one elongated aperture extending therethrough proximate said surface mountable contact sections;

whereby upon disposing said shroud on said connector housing and mounting said housing and shroud to said circuit board and soldering said surface mountable contact sections to corresponding circuit pads on said board, said at least one aperture permits sufficient heat generated by a board remote source during the soldering process to reach said contact pads to melt said solder thereby assuring electrical engagement of said terminals with said circuitry on said board.

2. The conductive shroud of claim 1 wherein said second portion of said body includes a plurality of elongated apertures extending therethrough.

3. A connector and ground shroud assembly comprising:

an electrical connector having a housing with a plurality of electrical terminals disposed therein, said terminals including surface mountable contact sections extending outwardly of said housing for electrically engaging circuitry on a circuit board, said connector being adapted to receive and electrically mate to an electrical device; and a ground shroud adapted for electrically engaging ground circuitry of said circuit board for providing a ground reference for said terminals, said shroud including:

an electrically conductive plate-like body having first and second portions, said first portion being adapted to be disposed on a board remote surface of said connector housing, said first portion including at least one first contact section adapted to engage a ground contact of the mating electrical device; and said second portion being configured to extend over said surface mountable contact sections when said shroud is disposed on said housing, said second portion having at least one second contact section extending outwardly therefrom for engagement to said ground circuitry of said circuit board;

said second portion further including at least one elongated aperture extending therethrough proximate said surface mountable contact sections;

whereby upon disposing said shroud on said connector housing and mounting said housing and shroud to said circuit board and soldering said surface mountable contact sections to corresponding circuit pads on said board, said at least one aperture permits sufficient heat generated by a board remote source during the soldering process to reach said contact pads to melt said solder thereby assuring electrical engagement of said terminals with said circuitry on said board.

4. The connector and shroud assembly of claim 3 wherein said second portion of said body includes a plurality of elongated apertures extending therethrough.

* * * * *